US007771088B2

(12) United States Patent
Chen

(10) Patent No.: US 7,771,088 B2
(45) Date of Patent: Aug. 10, 2010

(54) LIGHT-EMITTING DIODE ILLUMINATING EQUIPMENT

(75) Inventor: Jen-Shyan Chen, Hsinchu (TW)

(73) Assignee: Neobulb Technologies, Inc., Brunei Darussalam ( * ) Notice: Subject to any disclaimer, the term of this patent is extended or adjusted under 35 U.S.C. 154(b) by 100 days.

(21) Appl. No.: 12/005,379

(22) Filed: Dec. 27, 2007

(65) Prior Publication Data

US 2008/0158888 A1 Jul. 3, 2008

(30) Foreign Application Priority Data

Dec. 29, 2006 (TW) ..... 95150057 A

(51) Int. Cl.

| | |
|---|---|
| ***F21V 29/00*** | (2006.01) |
| ***F21V 1/00*** | (2006.01) |
| ***F21S 4/00*** | (2006.01) |
| ***B60Q 1/06*** | (2006.01) |

(52) U.S. Cl. ..... 362/294; 362/249.02; 362/373; 362/240

(58) Field of Classification Search ..... 362/294, 362/373, 547, 240, 218, 249.02, 311.02
See application file for complete search history.

(56) References Cited

U.S. PATENT DOCUMENTS

| | | | | |
|---|---|---|---|---|
| 6,321,452 | B1 * | 11/2001 | Lin | 29/890.032 |
| 7,324,174 | B2 * | 1/2008 | Hafuka et al. | 349/61 |
| 7,325,949 | B1 * | 2/2008 | Wang | 362/373 |
| 7,329,030 | B1 * | 2/2008 | Wang | 362/373 |
| 7,434,959 | B1 * | 10/2008 | Wang | 362/249.01 |
| 2007/0070628 | A1 * | 3/2007 | Chen | 362/249 |
| 2007/0090737 | A1 * | 4/2007 | Hu et al. | 313/11 |
| 2007/0201225 | A1 * | 8/2007 | Holder et al. | 362/227 |
| 2008/0192478 | A1 * | 8/2008 | Chen | 362/294 |

FOREIGN PATENT DOCUMENTS

| | | |
|---|---|---|
| TW | 1252899 | 4/2006 |
| TW | 303333 | 12/2006 |
| TW | 200642121 | 12/2006 |

OTHER PUBLICATIONS

English Abstract of TW200642121.
English Abstract of TW303333.
English Abstract of TW252899.

* cited by examiner

*Primary Examiner*—Jong-Suk (James) Lee
*Assistant Examiner*—David R Crowe
(74) *Attorney, Agent, or Firm*—Thomas, Kayden, Horstemeyer & Risley, LLP.

(57) ABSTRACT

The invention provides a light-emitting diode illuminating equipment, including N diode light-emitting apparatuses and N optical devices, wherein N is a natural number. Each of the optical devices includes a lens. Each of the optical devices corresponds to one of the diode light-emitting apparatus, for modulating a light pattern of the corresponding diode light-emitting apparatus. In an embodiment, the lens of each of the optical devices is a cat's-eye-like lens. The lens includes a surface, where a groove is formed along an ellipse minor axis of the lens, such that the light transmitted through the lens can form a light pattern for a specific request.

21 Claims, 6 Drawing Sheets

LIGHT-EMITTING DIODE ILLUMINATING EQUIPMENT

BACKGROUND OF THE INVENTION

1. Field of the Invention

This present invention relates to a light-emitting diode illuminating equipment, and more particularly, to a light-emitting diode illuminating equipment with a secondary optics apparatus capable of generating a specific light pattern.

2. Description of the Prior Art

A light-emitting diode (LED) has advantages of power saving, vibration resistance, fast response, production ability, and so on, so the illuminating equipment with light sources of LEDs is currently being studied and developed. Please refer to FIGS. 1A and 1B. FIG. 1A is a front view of an illuminating equipment with a plurality of LEDs arranged in an array. FIG. 1B is a cross section along the line X-X in FIG. 1A. As shown in FIGS. 1A and 1B, the illuminating equipment gains high brightness by arranging a plurality of LEDs in an array. Further, each of the LEDs corresponds to a cup for reflecting and concentrating the light emitted by the corresponding LED, and then a higher brightness is gained. However, the way can concentrate the light isotropically at most and can not generate a specific light pattern for the satisfaction of a specific purpose. The illumination therefore is limited.

Therefore, there is a need to provide a new light-emitting diode illuminating equipment capable of providing a specific light pattern to solve the mentioned problems.

SUMMARY OF THE INVENTION

A scope of the invention is to provide a light-emitting diode illuminating equipment.

Another scope of the invention is to provide a light-emitting diode illuminating equipment with a secondary optics apparatus capable of generating a specific light pattern.

According to a preferred embodiment, a light-emitting diode illuminating equipment of the invention includes a heat-dissipating plate device, N heat-conducting devices, N diode light-emitting apparatuses, N optical devices, a hollow barrel, and a transparent shield, wherein N is a natural number. The heat-dissipating plate device has a first surface and a second surface opposite to the first surface. A plurality of heat-dissipating fins extends from the second surface. Each of the heat-conducting devices has a first portion and a second portion extending from the first portion and having a flat end. Each of the diode light-emitting apparatuses corresponds to one of the N heat-conducting devices. Each of the diode light-emitting apparatuses is disposed on the flat end of the corresponding heat-conducting device and converts electric energy into light. Each of the optical devices corresponds to one of the diode light-emitting apparatuses for modifying the light patter of the corresponding diode light-emitting apparatus. The hollow barrel has a first circumference and a second circumference. The hollow barrel is engaged with the heat-dissipating plate device through the first circumference to expose the heat-dissipating fins in air and to form a space for accommodating the heat-conducting devices and the diode light-emitting apparatuses. The transparent shield is engaged with the second circumference of the hollow barrel.

According to the preferred embodiment, the light-emitting diode illuminating equipment further includes a partition plate device which is disposed in the hollow barrel to divide the space into a first room and a second room. The partition plate device thereon has N holes. Each of the diode light-emitting apparatuses corresponds to one of the holes.

Therein, each of the optical devices includes a support and a lens. The support is detachable to be engaged with the partition plate device. The support includes a first opening and a second opening. The first opening includes a plurality of hooks for engaging the support to the partition plate device, and the second opening accommodates the lens. The lens can be an elliptical lens, a circular lens, a cat's-eye-like lens, an irregular lens, a polygonal lens, or other type lens (or lenses). According to the preferred embodiment, the lens is a cat's-eye-like lens. The lens has a surface. A groove is formed along an ellipse minor axis of the lens on the surface, so that the light emitted through the lens forms a light pattern to meet a specific request.

Therefore, the light emitted by each of the diode light-emitting apparatus is modified by the corresponding lens to generate the anisotropic light pattern to meet the specific request, such as road illumination. In a practical application, the light-emitting diode illuminating equipment of the invention generates different light patterns by adjusting or designing the lens to meet different requests.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1A:
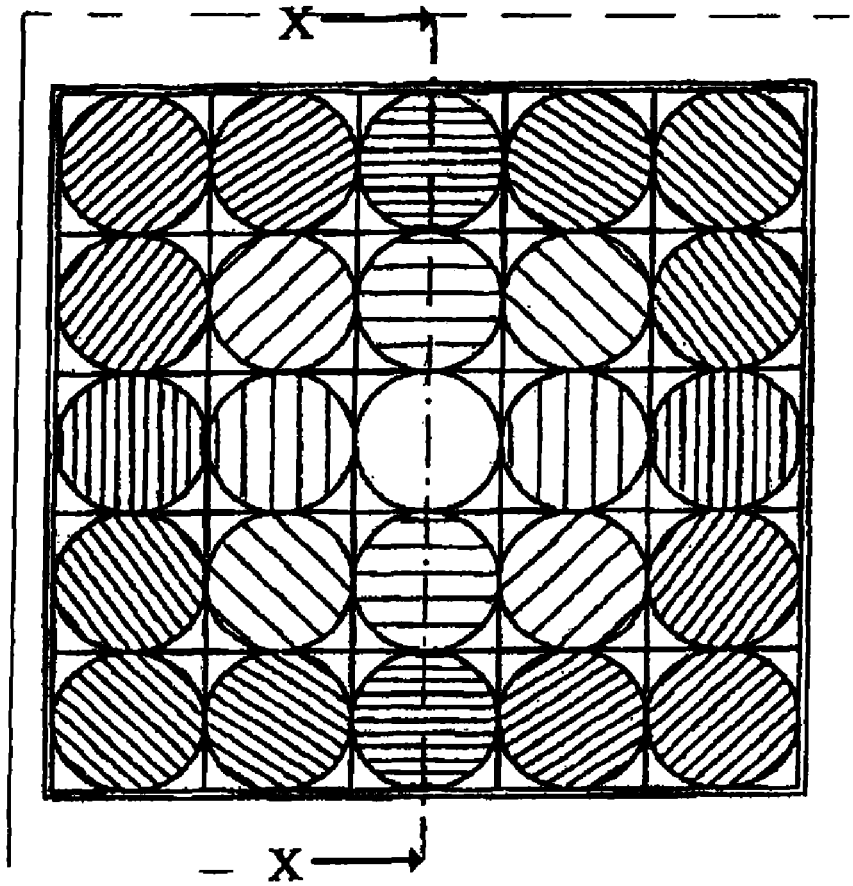
FIG. 1A (prior art)
FIG. 1A is a front view of an illuminating equipment with a plurality of LEDs arranged in an array.
Figure 1B:
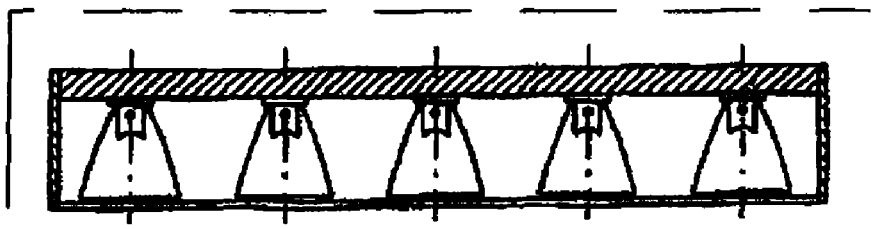
FIG. 1B (prior art)
FIG. 1B is a cross section along the line X-X in FIG. 1A.
Figure 2:
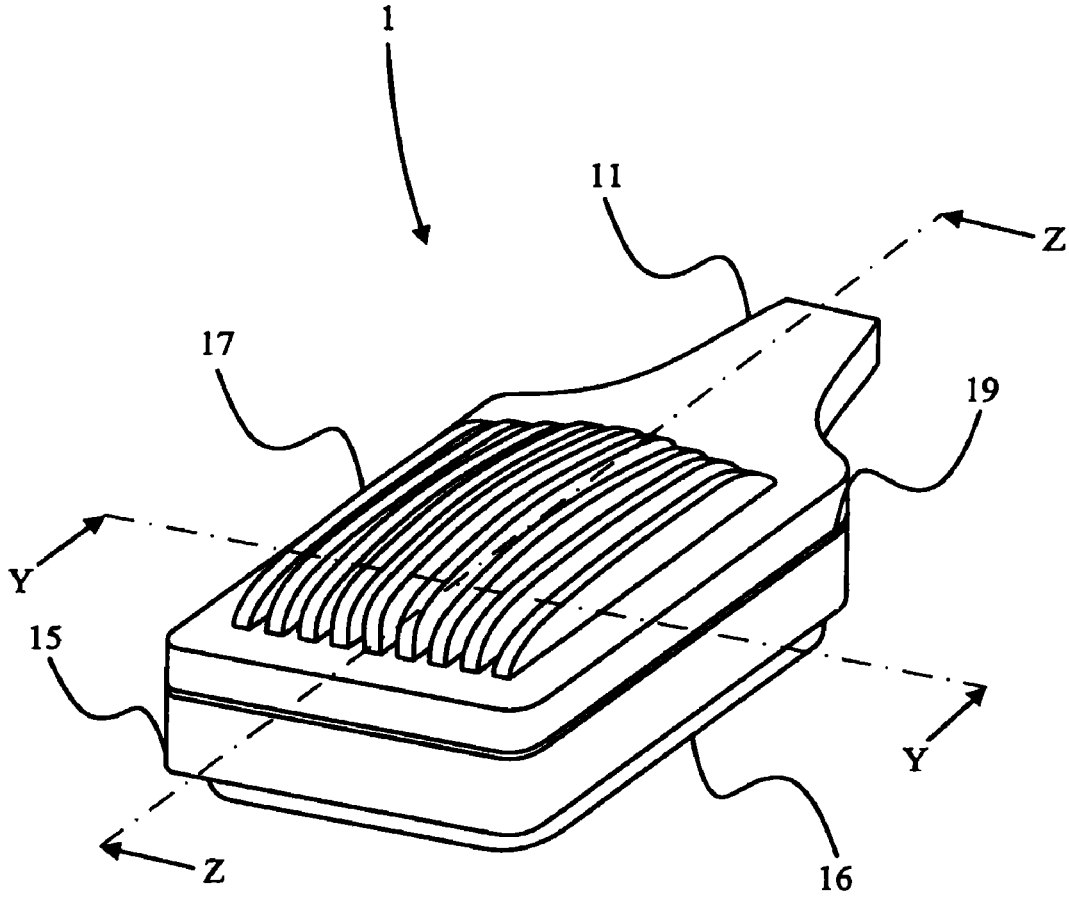
FIG. 2 is a perspective view of a light-emitting diode illuminating equipment according to a preferred embodiment of the invention.
Figure 3A:
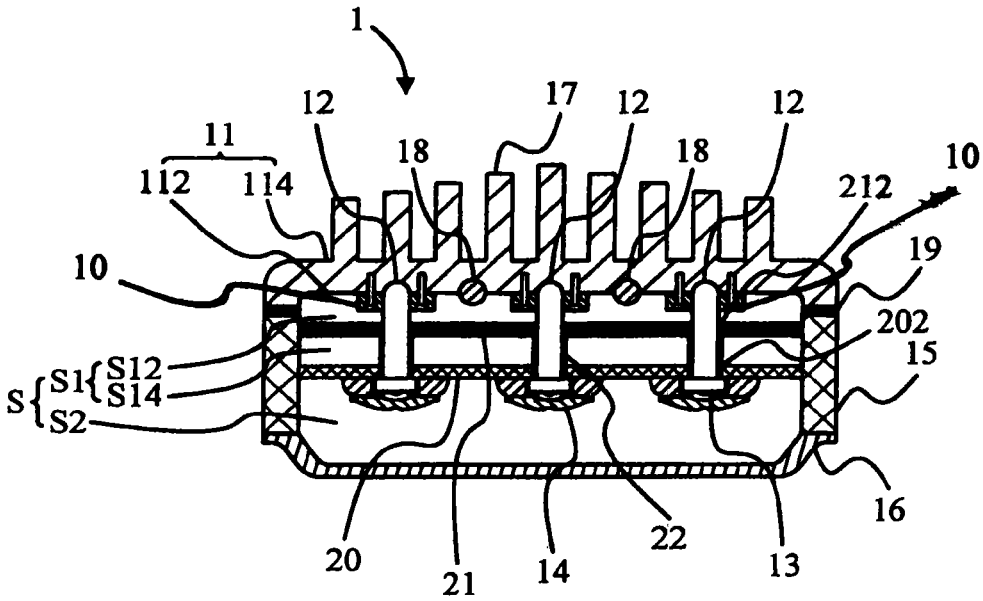
FIG. 3A is a cross section along the line Y-Y in FIG. 2.
Figure 3B:
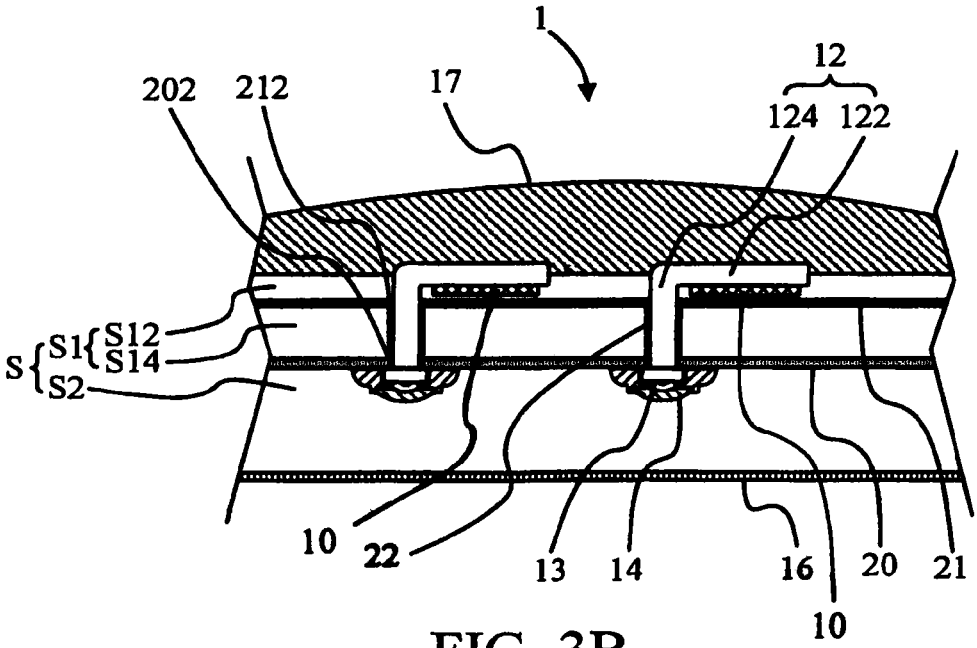
FIG. 3B is a partial cross section along the line Z-Z in FIG. 2.

Please refer to FIGS. 2, 3A, and 3B. FIG. 2 is a perspective view of a light-emitting diode illuminating equipment 1 according to a preferred embodiment of the invention. FIG. 3A is a cross section along the line Y-Y in FIG. 2. FIG. 3B is a partial cross section along the line Z-Z in FIG. 2.

According to the preferred embodiment, the light-emitting diode illuminating equipment 1 includes a heat-dissipating plate device 11, six first heat-conducting devices 12, six fixing plates 10, six diode light-emitting apparatuses 13, six optical devices 14, a hollow barrel 15, and a transparent shield 16. The heat-dissipating plate device 11 has a first surface 112 and a second surface 114 opposite to the first surface 112. A plurality of heat-dissipating fins 17 extends from the second surface 114. Each of the first heat-conducting devices 12 has a first portion 122 and a second portion 124 extending from the first portion 122 and having a flat end (not indicated in the figures).

It is noticed that each of the diode light-emitting apparatuses 13 corresponds to one of the first heat-conducting devices 12 and each of the diode light-emitting apparatuses 13 is flatly mounted on the flat end of the corresponding first heat-conducting device 12 and converts electric energy into light. Therefore, the heat produced in operation by each of the diode light-emitting apparatuses 13 is conducted from the flat end through the second portion 124 and the first portion 122 of the corresponding first heat-conducting device 12 to the heat-dissipating plate device 11 and the heat-dissipating fins 17, and then is dissipated by the heat-dissipating plate device 11 and the heat-dissipating fins 17.

The heat-dissipating plate device 11 of the light-emitting diode illuminating equipment 1 includes six first grooves (not indicated in the figures) formed on the first surface 112 of the heat-dissipating plate device 11. Each of the first grooves corresponds to one of the first heat-conducting devices 12. The shape of each of the first grooves is adapted to the profile of the first portion 122 of the corresponding first heat-conducting device 12 to tightly contact so as to enhance the heat-dissipating efficiency. Moreover, a heat-conducting material is filled between the first portion 122 of each of the first heat-conducting devices 12 and the corresponding first groove to enhance the heat-dissipating efficiency further.

Furthermore, the light-emitting diode illuminating equipment 1 includes two second heat-conducting devices 18 mounted tightly on the first surface 112 of the heat-dissipating plate device 11 to enhance the heat-dissipating effect of both the heat-dissipating plate device 11 and the heat-dissipating fins 17. As shown in the preferred embodiment, the second heat-conducting devices 18 and the first heat-conducting devices 12 are disposed to be interlaced so as to gain a better heat-dissipating efficiency. Moreover, the heat-dissipating plate device 11 includes two second grooves (not indicated in the figures) formed on the first surface 112 of the heat-dissipating plate device 11. Each of the second grooves corresponds to one of the second heat-conducting devices 18. The shape of each of the second grooves is adapted to the profile of the corresponding second heat-conducting device 18 to tightly contact so as to enhance the heat-dissipating efficiency. A heat-conducting material is filled between each of the second heat-conducting devices 18 and the corresponding second groove to enhance the heat-dissipating efficiency further. In addition, the quantity and the configuration of the second heat-conducting devices 18 are not limited to the above, but depend on the whole structure and the operating environment of product. In principle, the interlacing arrangement mentioned above still makes the heat-dissipating plate device 11 gain a good heat-dissipating efficiency.

According to the preferred embodiment of the invention, each of the optical devices 14 corresponds to one of the diode light-emitting apparatuses 13 for modifying the light pattern of the corresponding diode light-emitting apparatus 13. The hollow barrel 15 is engaged through a circumference thereof with the heat-dissipating plate device 11 to expose the heat-dissipating fins 17 in air and to form a space S for accommodating the first heat-conducting devices 12 and the diode light-emitting apparatuses 13. The transparent shield 16 is engaged with the hollow barrel 15 through another circumference thereof to seal the space S, but the seal is not necessary for the invention. Furthermore, the hollow barrel 15 is further engaged with the heat-dissipating plate device 11 through a heat-insulating ring 19 to reduce or insulate the heat conducted from the heat-dissipating plate device 11 and to form the situation of the light-emitting diode illuminating equipment 1 with hot top and cold bottom, which is more conducive to the heat-dissipating efficiency.

According to the preferred embodiment, the light-emitting diode illuminating equipment 1 further includes a partition plate device 20 disposed in the hollow barrel 15 to divide the space S into a first room S1 and a second room S2. The partition plate device 20 thereon has six first holes 202. Each of the diode light-emitting apparatuses 13 corresponds to one of the first holes 202. According to the preferred embodiment, each of the diode light-emitting apparatuses 13 passes through the corresponding first hole 202 and is disposed in the second room S2 (or in the corresponding first hole 202). The partition plate device 20 could mount the diode light-emitting apparatuses 13 or the first heat-conducting devices 12 secondarily. However, in a practical application, the positions of the diode light-emitting apparatuses 13 relative to the partition plate device 20 are not limited to the above description.

Figure 4A:
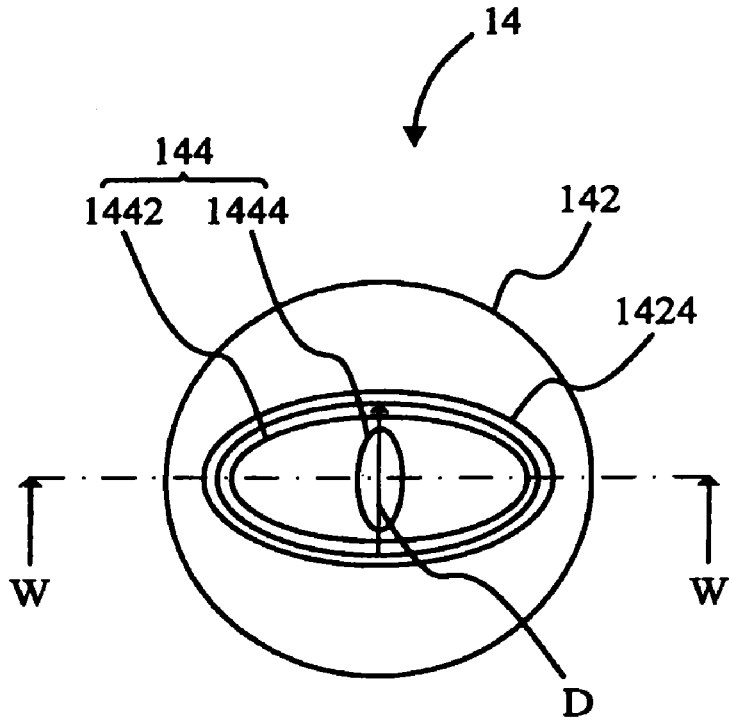
FIG. 4A is a front view of the optical device according to the preferred embodiment.
Figure 4B:
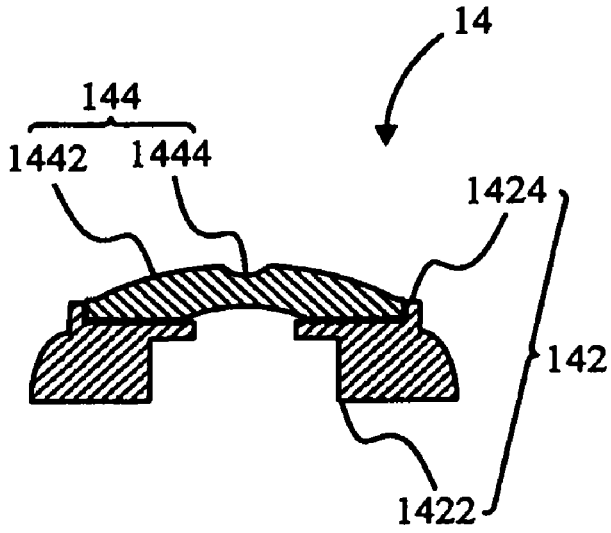
FIG. 4B is a cross section along the line W-W in FIG. 4A.

Please also refer to FIGS. 4A and 4B. FIG. 4A is a front view of the optical device 14 according to the preferred embodiment. FIG. 4B is a cross section along the line W-W in FIG. 4A. According to the preferred embodiment, each of the optical devices 14 includes a support 142 and a lens 144. The support 142 is detachable to be engaged with the corresponding diode light-emitting apparatus 13. The support 142 includes a first opening 1422 and a second opening 1424. The first opening 1422 is engaged with the corresponding diode light-emitting apparatus 13. The second opening 1424 accommodates the lens 144. Therein, the lens 144 could be an elliptical lens, a circular lens, a cat's-eye-like lens, an irregular lens, a polygonal lens, or other type lens (or lenses). According to the preferred embodiment, the lens 144 is a cat's-eye-like lens. The lens 144 has a surface 1442 and defines a direction D on the surface 1442. A groove 1444 is formed along the direction D on the surface 1442 of the lens 144, so that the light emitted through the lens 144 forms a light pattern to meet a specific request. According to the preferred embodiment, the direction D is an ellipse minor axis of the lens 144.

Figure 5:
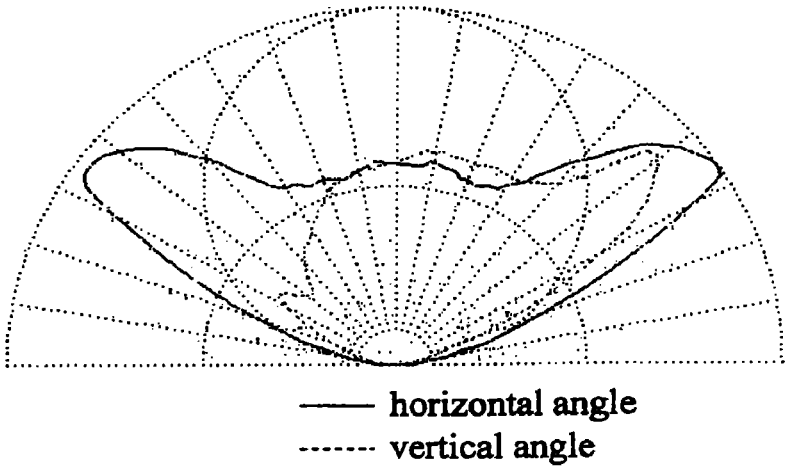
FIG. 5 is a schematic drawing of the light pattern formed according to the preferred embodiment.

Please refer to FIG. 5. FIG. 5 is a schematic drawing of the light pattern formed according to the preferred embodiment. The formed light pattern is symmetrical and shows that the light-emitting diode illumination equipment 1 can modify the conventional light pattern into the pattern elongated from side to side, which is quite conducive to the application of road illumination. In a practical application, the light-emitting diode illuminating equipment 1 of the invention generates light patterns for different requests by configuring different lenses. In addition, the material of the lens is not limited to a single material, and a compound lens can also be used in the invention. For example, the refractive index of the center portion of the lens is lower than that of the circumference portion of the lens, or the refractive index of the lens varies continuously, so that the brightness within the light pattern is uniform. Furthermore, in the field of packaging light-emitting diode, there is also a package of packaging a light-emitting diode with a package material into a protrusion to form a simple positive lens, or there is also a positive lens covered above the light-emitting diode after the packaging, so as to gain a concentration of light. However, they can not form a different light pattern by request. By contrast, the light-emitting diode illumination equipment of the invention can utilize the light-emitting diode made under the two package processes mentioned above to still form the requested light pattern efficiently with the optical devices 14.

Figure 6:
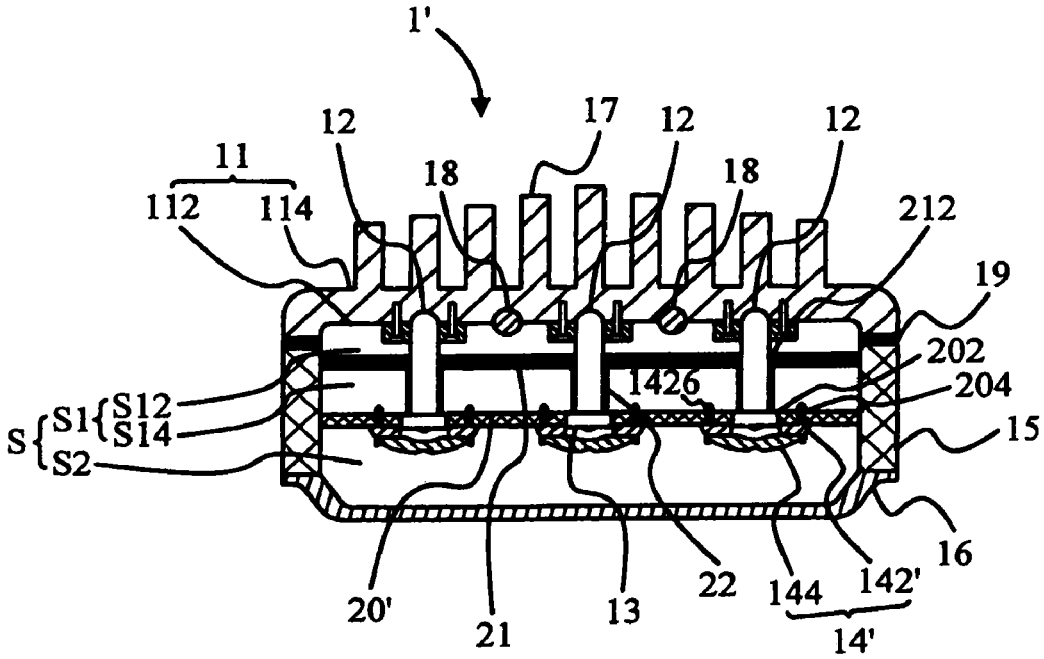
FIG. 6 is a cross section of a light-emitting diode illuminating equipment according to an embodiment.

Please refer to FIG. 6. FIG. 6 is a cross section of a light-emitting diode illuminating equipment 1' according to an embodiment. Compared with the preferred embodiment, the partition plate device 20' of the light-emitting diode illuminating equipment 1' thereon forms a plurality of holes 204 near each of the first holes 202, and the first opening of the support 142' of each of the optical devices 14' includes a plurality of hooks 1426. The hooks 1426 are inserted into the holes 204 so that the support 142' is engaged with the partition plate device 20'.

Figure 7:
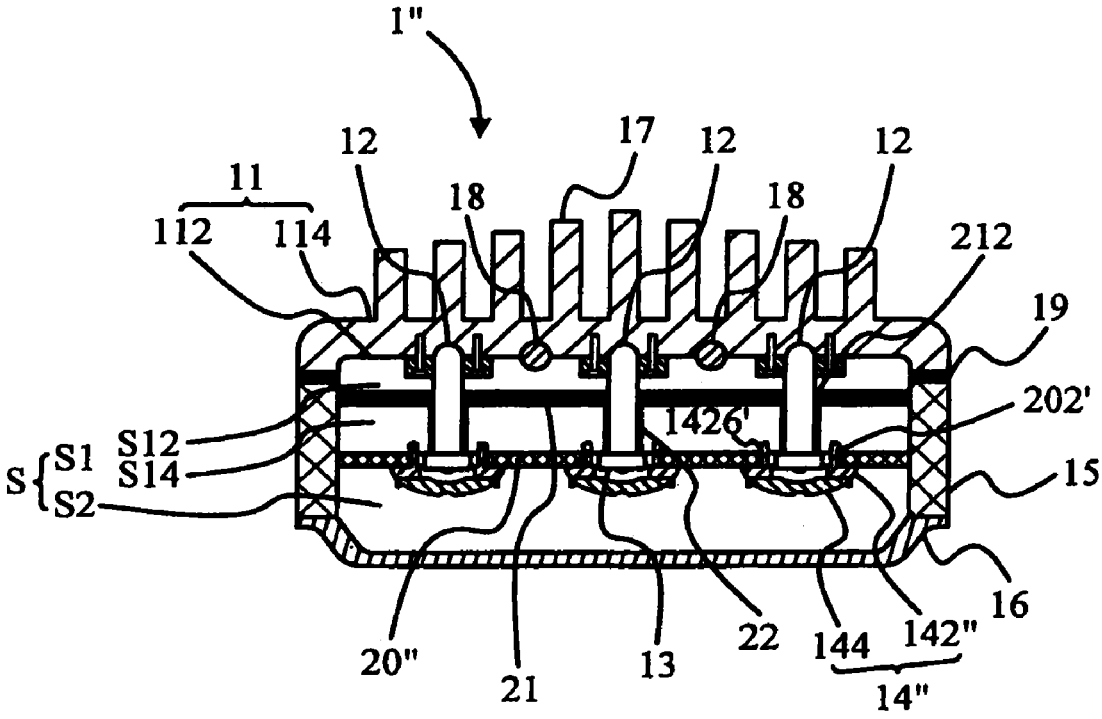
FIG. 7 is a cross section of a light-emitting diode illuminating equipment according to another embodiment.

Please refer to FIG. 7. FIG. 7 is a cross section of a light-emitting diode illuminating equipment 1" according to another embodiment. Compared with the preferred embodiment, the first opening of the support 142" of each of the optical devices 14" of the light-emitting diode illuminating equipment 1" includes a plurality of hooks 1426'. The hooks 1426' are inserted into the corresponding first hole 202' so that the support 142" is engaged with the partition plate device 20". It is noticed that the engagement of the support with the partition plate device of the light-emitting diode illuminating equipment of the invention can be designed to make the hooks formed on the partition plate device and to make the holes formed on the support, which still achieves the purpose of detachable engagement. In addition, the engagement could also be achieved by screwing with screws.

According to the preferred embodiment, the light-emitting diode illuminating equipment 1 further includes a heat-isolating plate device 21 disposed in the first room S1 to divide the first room S1 into a third room S12 and a fourth room S14. The heat-isolating plate device 21 thereon includes six second holes 212. The second portion 124 of each of the first heat-conducting devices 12 corresponds to one of the second holes 212 and passes through the corresponding second hole 212. Therefore, the heat conducted to the heat-dissipating plate device 11 does not radiate or conduct back to the fourth room S14 due to the isolation of the heat-isolating plate device 21, which avoids the heat impact of the heat to the diode light-emitting apparatuses 13. Furthermore, there is an insulating material is filled in gaps between the first heat-conducting devices 12 and the second holes 212, which enhances the heat-insulating effect. In addition, the light-emitting diode equipment 1 further includes a heat-insulating sleeve 22 disposed to cover the second portion 124 of one of the first heat-conducting devices 12, especially the second portion 124 in the fourth room S14, so that the heat produced in operation by the corresponding diode light-emitting apparatus 13 to said first heat-conducting device 12 does not dissipate into the fourth room S14, which further enhances the heat-dissipating efficiency of the heat-dissipating plate device 11. It is noticed that if the partition plate device 20 has the capability of heat isolation, the heat-isolating plate device 21 can be omitted for design simplification. The above structure is also applied to the embodiments mentioned above, as shown in FIGS. 6 and 7.

It is noticed that the above description is based on using the same kind of lens; however, each of the diode light-emitting apparatuses can correspond to different lenses respectively to gain various light patterns. In addition, in the above embodiments, the first heat-conducting devices 12 and the second heat-conducting devices 18 can be heat pipes, a heat columns, vapor chambers, or other heat-conducting devices. The first heat-conducting devices 12 and the second heat-conducting devices 18 are made of copper, aluminum, or other material with high heat-conducting efficiency. One of the diode light-emitting apparatuses 13 includes at least one light-emitting diode or laser diode and can use light-emitting diodes with different colors.

In summary, a secondary optics design is involved in the light-emitting diode illuminating equipment of the invention. The light pattern produced by the diode light-emitting apparatus is modified by the optical devices to meet different requests. Furthermore, the light-emitting diode illuminating equipment can produce various light patterns by adjusting and designing the optical devices, so as to meet more various requests. It is noticed that the above embodiments are based on the case of road lamp, but the invention is not limited to this. The invention is applied to any request for illumination, especially a request for a specific light pattern.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. Light-emitting diode illuminating equipment, comprising:

a heat-dissipating plate device comprising a first surface and a second surface;

a plurality of heat-dissipating fins extending from the second surface of the heat-dissipating plate;

N first heat-conducting devices, each of the N first heat-conducting devices comprising a flat top end and a first portion, the first portion being mounted on the first surface of the heat-dissipating plate device without punching through the first surface of the heat-dissipating plate, N being a natural number greater than one;

N diode light-emitting apparatuses, each of the N diode light-emitting apparatuses being corresponding to and disposed on one of the first heat-conducting devices and converting an electric energy into a light, wherein each of the light-emitting apparatuses being mounted directly on the flat top end of the corresponding heat conducting device;

N optical devices, each of the N optical devices corresponding to one of the diode light-emitting apparatuses for modifying a light pattern of the corresponding diode light-emitting apparatus;

a hollow barrel comprising a first circumference and a second circumference, the hollow barrel being engaged with the heat-dissipating plate device through the first circumference to expose the heat-dissipating fins in air and to form a space for accommodating the first heat-conducting devices and the diode light-emitting apparatuses; and a transparent shield engaged with the second circumference of the hollow barrel; and a plurality of fixing plates connecting the heat conducting device to the first surface of the heat dissipation plate.

2. The light-emitting diode illuminating equipment of claim 1, wherein each of the optical devices comprises a support and a lens, and the support is detachable to be engaged with the corresponding diode light-emitting apparatus.

3. The light-emitting diode illuminating equipment of claim 2, wherein the support comprises a first opening and a second opening, the first opening is engaged with the corresponding diode light-emitting apparatus, and the second opening accommodates the lens.

4. The light-emitting diode illuminating equipment of claim 3, wherein the lens is one selected from the group consisting of elliptical lens, circular lens, cat's-eye-like lens, irregular lens, and polygonal lens.

5. The light-emitting diode illuminating equipment of claim 4, wherein the N optical devices comprise a first optical device and a second optical device, and the lens of the first optical device is the same as the lens of the second optical device.

6. The light-emitting diode illuminating equipment of claim 4, wherein the N optical devices comprise a first optical device and a second optical device, and the lens of the first optical device is different from the lens of the second optical device.

7. The light-emitting diode illuminating equipment of claim 1, further comprising a partition plate device disposed in the hollow barrel to divide the space into a first room and a second room, the partition plate device thereon comprising N first holes, each of the diode light-emitting apparatuses corresponding to one of the N first holes.

8. The light-emitting diode illuminating equipment of claim 7, wherein each of the optical devices comprises a support and a lens, and the support is detachable to be engaged with the partition plate device.

9. The light-emitting diode illuminating equipment of claim 8, wherein the support comprises a first opening and a second opening, the first opening comprises a plurality of hooks for engaging the support to the partition plate device, and the second opening accommodates the lens.

10. The light-emitting diode illuminating equipment of claim 8, wherein the lens is one selected from the group consisting of elliptical lens, circular lens, cat's-eye-like lens, irregular lens, and polygonal lens.

11. The light-emitting diode illuminating equipment of claim 10, wherein the cat's-eye-like lens has a surface, a direction is defined on the surface, and a groove is formed along the direction on the surface.

12. The light-emitting diode illuminating equipment of claim 11, wherein the direction is an ellipse minor axis of the lens.

13. The light-emitting diode illuminating equipment of claim 7, further comprising a heat-isolating plate device disposed in the first room, the heat-isolating plate device thereon comprising N second holes, wherein each of the first heat-conducting devices comprises a second portion extending from the first portion and comprising the flat top end, the second portion of each of the first heat-conducting devices being not mounted on the first surface of the heat-dissipating plate device and corresponding to one of the second holes and passing through the corresponding second hole.

14. The light-emitting diode illuminating equipment of claim 13, further comprising a heat-insulating sleeve, the heat-insulating sleeve being disposed to cover part of the second portion of one of the first heat-conducting devices.

15. The light-emitting diode illuminating equipment of claim 1, wherein the heat-dissipating plate device comprises N first grooves formed on the first surface of the heat-dissipating plate device, and the first portion of each of the first heat-conducting devices is mounted on one of the first grooves correspondingly.

16. The light-emitting diode illuminating equipment of claim 15, wherein a heat-conducting material is filled between the first portion of each of the first heat-conducting devices and the corresponding first groove.

17. The light-emitting diode illuminating equipment of claim 1, further comprising a plurality of second heat-conducting devices mounted on the first surface of the heat-dissipating plate device.

18. The light-emitting diode illuminating equipment of claim 17, wherein the heat-dissipating plate device comprises a plurality of second grooves formed on the first surface of the heat-dissipating plate device, and each of the second heat-conducting devices is mounted on one of the second grooves correspondingly.

19. The light-emitting diode illuminating equipment of claim 18, wherein a heat-conducting material is filled between each of the second heat-conducting devices and the corresponding second groove.

20. The light-emitting diode illuminating equipment of claim 17, wherein the heat-dissipating plate device is a heat pipe.

21. The light-emitting diode illuminating equipment of claim 1, further comprising a heat-insulating ring, wherein the hollow barrel is engaged with the heat-dissipating plate device through the heat-insulating ring.

* * * * *